US012121093B2

(12) United States Patent
Minakuchi et al.

(10) Patent No.: US 12,121,093 B2
(45) Date of Patent: Oct. 22, 2024

(54) SWIMSUIT

(71) Applicant: MIZUNO CORPORATION, Osaka (JP)

(72) Inventors: Ai Minakuchi, Osaka (JP); Hiroyuki Tanaka, Osaka (JP); Shinji Tomimura, Osaka (JP); Miyoko Kamei, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 73 days.

(21) Appl. No.: 17/621,511

(22) PCT Filed: Jul. 1, 2020

(86) PCT No.: PCT/JP2020/025845
§ 371 (c)(1),
(2) Date: Dec. 21, 2021

(87) PCT Pub. No.: WO2021/006150
PCT Pub. Date: Jan. 14, 2021

(65) Prior Publication Data

US 2022/0346469 A1 Nov. 3, 2022

(30) Foreign Application Priority Data

Jul. 5, 2019 (JP) ..... 2019-126218

(51) Int. Cl.
*A41D 7/00* (2006.01)

(52) U.S. Cl.
CPC ..... *A41D 7/00* (2013.01); *A41D 2600/10* (2013.01)

(58) Field of Classification Search
CPC . A41D 1/22; A41D 7/00; A41D 7/005; A41D 13/0007; A41D 13/0017;
(Continued)

(56) References Cited

U.S. PATENT DOCUMENTS 4,475,552 A * 10/1984 Yoshihara ..... A41C 1/06 450/107
4,698,847 A * 10/1987 Yoshihara ..... A41C 1/06 450/7

(Continued)

FOREIGN PATENT DOCUMENTS

EP 1 342 423 9/2003
JP 2001-192903 7/2001

(Continued)

OTHER PUBLICATIONS

International Search Report issued in International Application No. PCT/JP2020/025845, Oct. 6, 2020, 5 pages w/ translation.

(Continued)

*Primary Examiner* — Heather Mangine
*Assistant Examiner* — Matthew R Marchewka
(74) *Attorney, Agent, or Firm* — HSML P.C.

(57) ABSTRACT

A swimsuit formed from a stretchable fabric that is configured to cover at least the buttocks and the abdomen in use, including: a first tightening portion configured to cover the entire abdomen and extend to the upper back; and a pair of symmetric first reinforcing bands each configured to extend from one side of an armhole of the swimsuit across the abdomen and down to an end portion of the swimsuit on the other side, the pair of first reinforcing bands intersecting with each other in an area of the swimsuit covering the abdomen. A swimsuit having this configuration can support the wearer's flat posture while preventing the abdomen from sinking during swimming.

19 Claims, 6 Drawing Sheets

(58) Field of Classification Search
CPC .. A41D 13/012; A41D 13/0525; A41D 31/02; A41D 31/18; A41D 31/185; A41D 2300/22; A41D 2300/332; A41D 2400/24; A41D 2400/38; A41D 2600/10; A41C 1/08; A41B 9/08
USPC ..... 2/67, 69, 221, 237; 450/136
See application file for complete search history.

(56) References Cited

U.S. PATENT DOCUMENTS 6,176,816 B1 * 1/2001 Dicker ..... A63B 21/4009 2/69.5
8,533,864 B1 * 9/2013 Kostrzewski ..... A41D 13/0015 2/69
D908,317 S * 1/2021 Berger ..... D2/731
2003/0028952 A1 2/2003 Fujii et al.
2004/0255358 A1 * 12/2004 Ota ..... A41D 31/18 2/69
2007/0149093 A1 * 6/2007 Lutz ..... A41C 3/00 450/1
2009/0038047 A1 * 2/2009 Di Lorenzo ..... A41D 7/005 2/67
2010/0077527 A1 * 4/2010 Lee ..... A41D 31/18 2/69
2013/0160189 A1 * 6/2013 Yang ..... A63B 71/12 2/227
2014/0338089 A1 * 11/2014 Brooks ..... A41D 13/012 2/2.15
2015/0107000 A1 * 4/2015 Tanaka ..... A41D 1/08 2/227
2016/0015089 A1 * 1/2016 Palese ..... A41C 1/12 450/156
2017/0079339 A1 * 3/2017 Yeomans ..... A41D 13/02
2017/0245561 A1 8/2017 Flockton, et al.
2019/0059465 A1 * 2/2019 Zimmer ..... A41D 7/00
2020/0107590 A1 * 4/2020 Berger ..... A41D 7/005

FOREIGN PATENT DOCUMENTS

JP 2005-105477 4/2005
JP 2009-293145 12/2009
JP 2014-091894 5/2014
JP 2015-178691 10/2015
JP 2017-525864 9/2017
WO 2016/027068 2/2016
WO 2017/144940 8/2017

OTHER PUBLICATIONS

Written Opinion issued in International Application No. PCT/JP2020/025845, Oct. 6, 2020, 4 pages.

* cited by examiner

SWIMSUIT

TECHNICAL FIELD

The present invention relates to a swimsuit that is configured to cover at least the buttocks and the abdomen of a wearer in use.

BACKGROUND ART

Swimsuits designed to reduce water resistance are demanded in swimming, particularly in competitive swimming. An example of the water resistance is form drag that depends on a wearer's body shape. Patent Document 1 discloses a swimsuit that includes a tightening portion in an area of the swimsuit covering the gluteus maximus and part of the hamstrings to prevent the form drag caused by the lowered position of the waist or the legs as compared with the position of the upper body during swimming. Patent Document 2 proposes a swimsuit that includes tension bands, each following a path that extends along the outside of a thigh area of the swimsuit to a hip area of the swimsuit and inwardly from the hip area across an upper glute area of the swimsuit toward a mid-line of the swimsuit, to highly support an appropriate body position. Patent Document 3 proposes a swimsuit in which materials having different tensions are bordering in an X pattern in an anterior region of the trunk portion to support the wearer's body trunk.

PRIOR ART DOCUMENTS

Patent Documents

Patent Document 1: JP 2014-091894A
Patent Document 2: JP 2017-525864 A
Patent Document 3: WO2017/144940 A1

DISCLOSURE OF INVENTION

Problem to be Solved by the Invention

However, the swimsuits of Patent Documents 1 to 3 do not adequately prevent the abdomen from sinking during swimming.

To solve the above problem, it is an object of the present invention to provide a swimsuit that supports the wearer's flat posture while preventing the abdomen from sinking during swimming.

Means for Solving Problem

The present invention relates to a swimsuit formed from a stretchable fabric that is configured to cover at least the buttocks and the abdomen in use, including: a first tightening portion configured to cover the entire abdomen and extend to the upper back; and a pair of symmetric first reinforcing bands, each configured to extend from one side of an armhole of the swimsuit across the abdomen and down to an end portion of the swimsuit on the other side, the pair of first reinforcing bands intersecting with each other in an area of the swimsuit covering the abdomen.

In the swimsuit of the present invention, it is preferred that the pair of first reinforcing bands are each configured to extend from one side of the armhole of the swimsuit across the abdomen to the lateral thigh on the other side and down to the end portion of the swimsuit.

In the swimsuit of the present invention, the first tightening portion may be formed from a double cloth. In the swimsuit of the present invention, the first reinforcing bands may be formed from at least one selected from the group consisting of an adhesive, a stretchable fabric, and a tension tape.

In the swimsuit of the present invention, it is preferred that the intersection of the pair of first reinforcing bands is configured to be positioned between the lower edge of the costal arch and the lower edge of the anterior superior iliac spine. It is preferred that the swimsuit has a clothing pressure of 20 hPa or more at a part in the abdomen area 5 cm horizontally away from the intersection of the pair of first reinforcing bands. It is preferred that the swimsuit has a clothing pressure of 1.5 hPa or more at a part in the abdomen area 7 cm vertically away from the intersection of the pair of first reinforcing bands.

It is preferred that the swimsuit of the present invention includes a second tightening portion configured to cover the buttock and at least part of the thigh on each of the left and right sides.

It is preferred that the swimsuit of the present invention includes two or more second reinforcing bands on each of the left and right sides that are configured to extend from the buttock to the thigh along the body length direction and intersect with each other, the intersection of the two or more second reinforcing bands being configured to be positioned between the top of the buttock and a section of the hamstrings one-third from the proximal end of the hamstrings. It is preferred that the intersection of the two or more second reinforcing bands is configured to be positioned in an area of the swimsuit covering part of the hamstrings.

Effect of the Invention

The present invention provides a swimsuit that supports the wearer's flat posture while preventing the abdomen from sinking during swimming.

BRIEF DESCRIPTION OF DRAWINGS

FIG. 1 schematically illustrates the inside (body surface side) of a swimsuit (women's all-in-one half spats type) according to an embodiment of the present invention.

FIG. 2 schematically illustrates the inside (body surface side) of a swimsuit (women's all-in-one half spats type) according to an embodiment of the present invention.

FIG. 3 schematically illustrates the inside (body surface side) of a swimsuit (women's one-piece type) according to an embodiment of the present invention.

FIG. 4 schematically illustrates the inside (body surface side) of a swimsuit (women's one-piece type) according to an embodiment of the present invention.

FIG. 6 schematically illustrates the inside (body surface side) of a swimsuit (women's all-in-one half spats type)

according to Comparative Example 2.

DESCRIPTION OF THE INVENTION

Figure 1C:
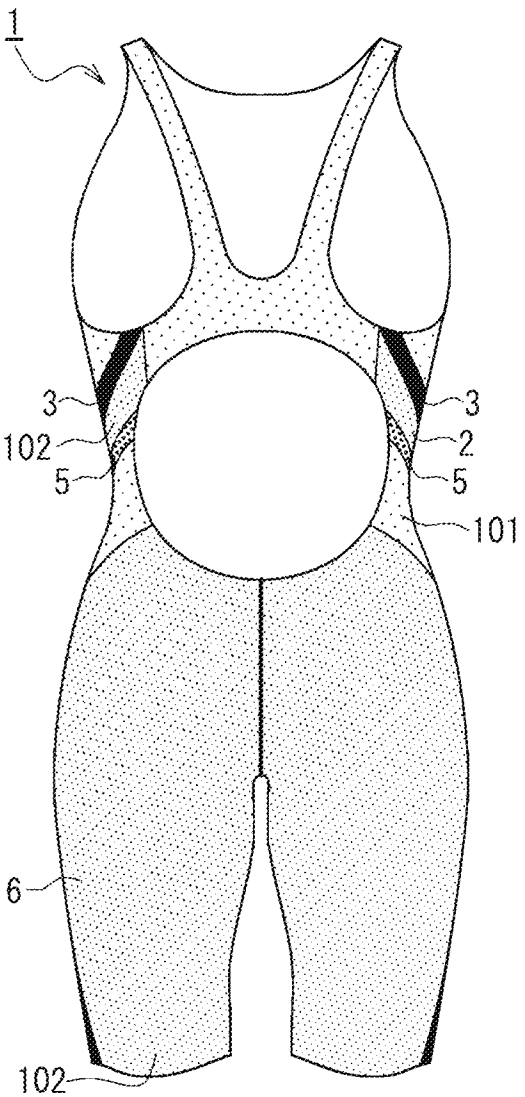
FIG. 1C is the rear view.

The present inventors have repeated studies to solve the above problem and found that the first tightening portion and the pair of first reinforcing bands that are provided in an area of the swimsuit covering the abdomen increase the pressure to the abdomen, thus preventing the abdomen from sinking during swimming and supporting the wearer's flat posture. Specifically, the first tightening portion that is configured to cover the entire abdomen and extend to the upper back applies the surface pressure to the abdomen, thus increasing the pressure to the abdomen and supporting the wearer's flat posture. Further, the pair of symmetric first reinforcing bands that intersect with each other in an area of the swimsuit covering the abdomen are configured to extend from one side of an armhole of the swimsuit across the abdomen and down to an end portion of the swimsuit on the other side, thus effectively increasing the pressure to the abdomen in synergy with the first tightening portion and supporting the wearer's flat posture more effectively. In terms of obtaining an equivalent support effect, the combination of the first tightening portion and the first reinforcing bands can synergistically increase the pressure to the abdomen more effectively and maintain the wearer's flat posture more easily as compared with the case of using the first tightening portion alone. In particular, the swimsuit helps wearers to improve their times in any competitive swimming strokes and is suitably used as a competition swimsuit.

The shape of the swimsuit in one or more embodiments of the present invention is not particularly limited as long as the swimsuit covers at least the buttocks and the abdomen in use. The swimsuit may be a one-piece type, an all-in-one type (e.g., a half spats type, a long spats type), or a full-body type. The swimsuit may be either sleeved or sleeveless. Although not particularly limited, the swimsuit of the present invention preferably has a back hole, from the viewpoint of wearability.

In one or more embodiments of the present invention, the term "stretchable fabric" means that the fabric has an elongation percentage of more than 0% in at least one of the body length direction or the body width direction of the fabric.

In one or more embodiments of the present invention, the term "tightening portion" refers to a portion having a higher tightening force than adjacent areas. Specifically, the tightening portion in the present invention has a lower elongation percentage or a higher tensile elastic modulus than adjacent areas in at least one of the body length direction or the body width direction (also called a circumferential direction).

In one or more embodiments of the present invention, the elongation percentage of the fabric is measured based on JIS L 1096 8.14.1, Method A (load: 17.6N, tensile speed: 200 mm/min).

In one or more embodiments of the present invention, the tensile elastic modulus of the fabric can be measured and calculated based on JIS L 1096 8.14., Method A. Specifically, a piece of a fabric is fixed to a tensile tester such that the piece of the fabric has a width of 5 cm and a length of 10 cm, and then elongated, and the tensile elastic modulus ($N/mm^2$) of the fabric is determined from the gradient of stress at 5% elongation. The length of the piece of the fabric means the size thereof in a direction corresponding to the measurement direction. For example, in the case of measuring the tensile elastic modulus in the body length direction, the length of the piece of the fabric means the size of the piece of the fabric in the body length direction. In the case of measuring the tensile elastic modulus in the body width direction, the length of the piece of the fabric means the size of the piece of the fabric in the body width direction.

In one or more embodiments of the present invention, the stretchable fabric constituting the swimsuit is not particularly limited, and any stretchable fabrics that are usually used for swimsuits can be used. For example, a one-way or two-way woven fabric containing elastic yarns, or a one-way or two-way knitted fabric containing elastic yarns is preferable. The elastic yarns are preferably at least one selected from the group consisting of elastic polyurethane yarns and elastic polyester yarns. Such elastic yarns have high stretchability and are suitably used in sports clothing. The elastic yarns may be used as bare yarns to be combined with non-elastic yarns (rigid yarns) or as covered yarns to be covered with polyester fibers or nylon fibers. The stretchable fabric may be a double cloth.

The stretchable fabric has a mass per unit area ranging from preferably 50 $g/m^2$ or more and 400 $g/m^2$ or less, more preferably 80 $g/m^2$ or more and 300 $g/m^2$ or less, and further preferably 100 $g/m^2$ or more and 200 $g/m^2$ or less. Within the above range, the stretchable fabric does not to become see-through and is aesthetically suitable, light, and excellent in wearability.

The stretchable fabric has an elongation percentage in the body length direction of preferably, but not particularly limited to, 15% or more and 75% or less, more preferably 20% or more and 65% or less, and further preferably 25% or more and 55% or less, from the viewpoint of wearability and a close fit, for example. The stretchable fabric constituting the swimsuit has an elongation percentage in the body width direction of preferably, but not particularly limited to, 30% or more and 75% or less, and more preferably 35% or more and 65% or less, from the viewpoint of wearability and a dose fit, for example.

In one or more embodiments of the present invention, the first tightening portion is preferably formed from, but not particularly limited to, a double cloth in which two fabrics are placed one on top of the other, from the viewpoint of easily obtaining a predetermined tightening force. Specifically, the first tightening portion may be formed from a double cloth in which a second fabric is placed on a first fabric constituting other areas. The edges of the two fabrics may be bonded together using an adhesive to form a double cloth. The kind and amount of fiber, the elongation percentage, and other properties of the first fabric and the second fabric may be the same or different from each other. The second fabric may be arranged either on the front side or back side of the first fabric.

The first tightening portion has an elongation percentage in the body length direction of preferably 10% or more and 50% or less, more preferably 10% or more and 45% or less, and further preferably 10% or more and 40% or less, from the viewpoint of easily increasing the surface pressure to the abdomen and easily maintaining the flat posture. Moreover, the first tightening portion has an elongation percentage in the body width direction of preferably 20% or more and 70% or less, and more preferably 20% or more and 60% or less, from the viewpoint of easily increasing the surface pressure to the abdomen and easily maintaining the flat posture.

The pair of first reinforcing bands are arranged symmetrically and substantially in an X-shape as viewed from the front. The intersection of the pair of first reinforcing bands is preferably configured to be positioned between the lower edge of the costal arch and the lower edge of the anterior superior iliac spine, and more preferably between the lower edge of the costal arch and the iliac crest, from the viewpoint of more effectively increasing the pressure to the abdomen and easily maintaining the flat posture.

The first reinforcing bands overlap the first tightening portion in the abdomen. In the upper back, the first reinforcing bands preferably overlap the first tightening portion or are arranged along the periphery of the first tightening portion, from the viewpoint of further enhancing the synergistic effect with the first tightening portion.

It is preferred that the pair of first reinforcing bands are each configured to extend from one side of the armhole of the swimsuit across the abdomen to the lateral thigh on the other side and down to the end portion of the swimsuit, from the viewpoint of more effectively increasing the pressure to the abdomen and easily maintaining the flat posture.

The first reinforcing bands may be formed from at least one selected from the group consisting of an adhesive, a stretchable fabric, and a tension tape. Specifically, the first reinforcing bands can be formed by any of the following: applying an adhesive such as a tape-shaped adhesive to a stretchable fabric constituting the swimsuit; bonding a tape-shaped stretchable fabric to a stretchable fabric constituting the swimsuit with an adhesive such as a tape-shaped adhesive; bonding a tension tape to a stretchable fabric constituting the swimsuit with an adhesive such as a tape-shaped adhesive; and bonding a tension tape to a stretchable fabric constituting the swimsuit with an adhesive such as a tape-shaped adhesive and thereafter bonding a tape-shaped stretchable fabric onto the tension tape with an adhesive such as a tape-shaped adhesive.

The first reinforcing bands have an elongation percentage in the longitudinal direction of preferably 0% or more and 35% or less, and more preferably 0% or more and 30% or less, from the viewpoint of more effectively increasing the pressure to the abdomen and easily maintaining the flat posture. Specifically, the tape-shaped adhesive, the tape-shaped stretchable fabric, or the tension tape has an elongation percentage in the longitudinal direction of preferably 20% or more and 65% or less, and more preferably 20% or more and 60% or less.

The first reinforcing bands have a width of preferably 5 mm or more and 30 mm or less, and more preferably 10 mm or more and 20 mm or less, from the viewpoint of reducing the surface friction, for example. Specifically, the tape-shaped adhesive, the tape-shaped stretchable fabric, and the tension tape have a width of preferably 5 mm or more and 30 mm or less, and more preferably 10 mm or more and 20 mm or less, from the viewpoint of reducing the surface friction, for example.

The adhesive is preferably a hot melt adhesive. Examples of the hot melt adhesive include, but are not particularly limited to, a sheet type, a nonwoven fabric type, and a liquid type. The sheet type and the nonwoven fabric type may be cut into a tape shape with a predetermined width, arranged at a place where the first reinforcing bands are to be positioned, and heated. The liquid type may be applied in a tape shape with a predetermined width to a place where the first reinforcing bands are to be positioned, and heated.

As the tape-shaped stretchable fabric, those exemplified above as the stretchable fabric constituting the swimsuit that are cut into a tape shape with a predetermined width can be used appropriately.

The tension tape is not particularly limited, and may be either a knitted fabric or a woven fabric. For example, a variety of commercially available tension bands can be selected appropriately. The tension tape has a tensile elastic modulus in the body length direction (corresponding to the longitudinal direction of the tension tape) of preferably, but not particularly limited to, $5\times10^{-5}$ N/mm$^2$ or more and $30\times10^{-5}$ N/mm$^2$ or less, and more preferably $10\times10^{-5}$ N/mm$^2$ or more and $20\times10^{-5}$ N/mm$^2$ or less.

In one or more embodiments, the swimsuit of the present invention has a clothing pressure at the intersection of the pair of first reinforcing bands of preferably, but not particularly limited to, 25 hPa or more, more preferably 30 hPa or more, and further preferably 35 hPa or more, from the viewpoint of more effectively increasing the pressure to the abdomen and easily maintaining the flat posture. The swimsuit has a clothing pressure of preferably 22 hPa or more at a part 5 cm horizontally (i.e., the body width direction) away from the intersection of the pair of first reinforcing bands (i.e., the part being in the first tightening portion), more preferably 24 hPa or more, and further preferably 26 hPa or more. The swimsuit has a clothing pressure of preferably 1.5 hPa or more at a part 7 cm vertically (i.e., the body length direction) away from the intersection of the pair of first reinforcing bands (i.e., the part being in the first tightening portion), more preferably 2.0 hPa or more, and further preferably 2.5 hPa or more.

In one or more embodiments, the swimsuit of the present invention has a clothing pressure at the intersection of the pair of first reinforcing bands of preferably, but not particularly limited to, 50 hPa or less, more preferably 48 hPa or less, and further preferably 46 hPa or less, from the viewpoint of not hindering a comfortable fit in the abdomen. The swimsuit has a clothing pressure of preferably 32 hPa or less at a part 5 cm horizontally (i.e., the body width direction) away from the intersection of the pair of first reinforcing bands (i.e., the part being in the first tightening portion), more preferably 30 hPa or less, and further preferably 28 hPa or less. The swimsuit has a clothing pressure of preferably 4.2 hPa or less at a part 7 cm vertically (i.e., the body length direction) away from the intersection of the pair of first reinforcing bands (i.e., the part being in the first tightening portion), more preferably 4.1 hPa or less, and further preferably 4.0 hPa or less.

In one or more embodiments of the present invention, the clothing pressure can be measured using a clothing pressure measuring device ("contact pressure measuring device AMI3037-2 (2B)" manufactured by AMI® Techno CO., LTD.) by attaching clothing pressure sensors to measurement parts on a mannequin (female mannequin manufactured by SUN CREATE CO., LTD.).

In one or more embodiments, it is preferred that the swimsuit of the present invention further includes a second tightening portion configured to cover the buttock and at least part of the thigh on each of the left and right sides, from the viewpoint of stabilizing the posture of the lower extremity in the water and supporting the movement of the hamstrings. More preferably, the second tightening portion is configured to cover the buttocks and the thighs entirely. Further preferably, the second tightening portion is coni gored to extend to a lower end of the swimsuit.

In one or more embodiments of the present invention, the second tightening portion is preferably formed from, but not particularly limited to, a double cloth in which two fabrics are placed one on top of the other, from the viewpoint of easily obtaining a predetermined tightening force. Specifically, the second tightening portion may be formed from a double cloth in which a first fabric constituting other areas is combined with a second fabric. The edges of the two fabrics may be bonded together using an adhesive to form a double cloth. The kind and amount of fiber, the elongation percentage, and other properties of the first fabric and the second fabric may be the same or different from each other. The second fabric may be arranged either on the front side or back side of the first fabric.

The second tightening portion has an elongation percentage in the body length direction of preferably 10% or more and 50% or less, more preferably 10% or more and 45% or less, and further preferably 10% or more and 40% or less, from the viewpoint of stabilizing the posture of the lower extremity in the water and supporting the movement of the hamstrings. The second tightening portion has an elongation percentage in the body width direction of preferably 20% or more and 70% or less, and more preferably 20% or more and 60% or less, from the viewpoint of stabilizing the posture of the lower extremity in the water and supporting the movement of the hamstrings. The fabric of the first tightening portion and the second tightening portion may be the same or different from each other.

Figure 5:
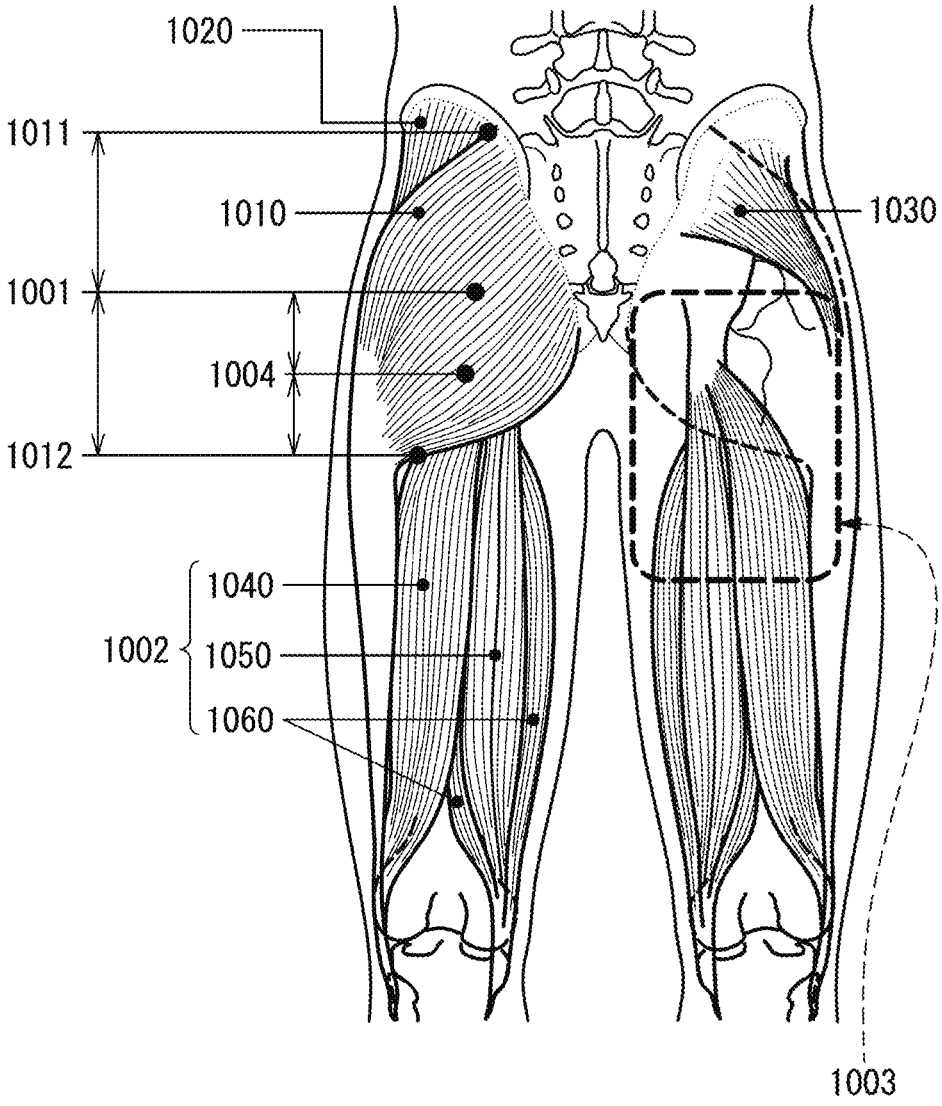
FIG. 5 is a partial schematic view of the posterior lower body from the waist to the knees, illustrating the position of an intersection of two or more second reinforcing bands.

In one or more embodiments of the present invention, it is preferred that the swimsuit includes two or more second reinforcing bands on each of the left and right sides that are configured to extend from the buttock to the thigh along the body length direction and intersect with each other, the intersection of the two or more second reinforcing bands being configured to be positioned between the top of the buttock and a section of the hamstrings one-third from the proximal end of the hamstrings, from the viewpoint of more effectively stabilizing the posture of the lower extremity in the water and supporting the movement of the hamstrings. During various swimming strokes such as the crawl, butterfly, backstroke, and breaststroke, the skin stretches greatly in a region spanning from the top of the buttock to the section of the hamstrings one-third from the proximal end. As described above, by providing the second tightening portion in combination with the two or more reinforcing bands that are configured to intersect with each other along the body length direction (also called a body height direction) and position 1003 the intersection of the two or more reinforcing bands in a region where the skin stretches to a large extent during swimming, i.e., from the top 1001 of the buttock to the section of the hamstrings 1002 one-third from the proximal end, the posture of the lower extremity can be stabilized in the water more effectively and the movement of the hamstrings 1002 can be supported. For example, such a structure can reduce the load on muscles during swimming, including the hip joint extensors such as the gluteus maximus 1010, the gluteus medius 1020, the gluteus minimus 1030, and the hamstrings 1002, and the hip joint medial rotators such as the semitendinosus, the semimembranosus, the gluteus medius (lateral side), the gluteus minimus (lateral side), and the tensor fasciae latae. The term "hamstrings" collectively refer to the biceps femoris 1040, the semimembranosus 1050, and the semitendinosus 1060, which are located at the back of the thigh (the posterior side of the lower extremity). In one or more embodiments of the present invention, the expression "section of the hamstrings one-third from the proximal end" means a section of the hamstrings at a distance of 100%/3 from the proximal end of the hamstrings, provided that the length of the hamstrings 1002 in the body height direction from the proximal end to the distal end of the hamstrings is taken as 100%. Also, the expression "top of the buttock" means a section of the buttock at a distance of 100%/2 from the lower end 1012 of the gluteus maximus 1010, provided that the length of the gluteus maximus 1010 in the body height direction from the upper end 1011 to the lower end 1012 thereof is taken as 100%. FIG. 5 is a partial schematic view of the posterior lower body from the waist to the knees, illustrating the position of the intersection of the two or more second reinforcing bands.

The second reinforcing bands are arranged, on each of the left and right sides, to extend from the buttock to the thigh along the body length direction. The number of the second reinforcing bands on each of the left and right sides are not particularly limited and may be two or more, for example, two, three, four, or more than that, as long as they extend from the buttock to the thigh along the body length direction, and the intersection is positioned between the top of the buttock and the section of the hamstrings one-third from the proximal end. It is preferred that two second reinforcing bands are arranged to extend from the buttock to the thigh on each of the left and right sides, from the viewpoint of a comfortable fit. The two second reinforcing bands arranged on each of the left and right sides to extend from the buttock to the thigh will be substantially in an X-shape from the buttock to the thigh on each of the left and right sides.

The second reinforcing bands may extend to the waist. This can stabilize the posture of the lower extremity in the water more effectively. The second reinforcing bands may extend to the lower end of the swimsuit. This stabilizes the posture in the water more effectively. It is preferred that at least one of the second reinforcing bands is arranged to pass through a region surrounding the sacrum, from the viewpoint of stabilizing the posture in the water more effectively. The intersection of the second reinforcing bands is preferably positioned in an area of the swimsuit covering part of the hamstrings, and more preferably positioned in an area of the swimsuit covering part of at least one of the biceps femoris or the semitendinosus, from the viewpoint of stabilizing the posture in the water more effectively and supporting the movement of the hamstrings.

The second reinforcing bands may be formed from, but not particularly limited to, at least one selected from the group consisting of an adhesive, a stretchable fabric, and a tension tape. Specifically, the second reinforcing bands can be formed by any of the following: applying a tape-shaped adhesive to a stretchable fabric constituting the swimsuit; bonding a tape-shaped stretchable fabric to a stretchable fabric constituting the swimsuit with an adhesive such as a tape-shaped adhesive; bonding a tension tape to a stretchable fabric constituting the swimsuit with an adhesive such as a tape-shaped adhesive; and bonding a tension tape to a stretchable fabric constituting the swimsuit with an adhesive such as a tape-shaped adhesive and thereafter bonding a tape-shaped stretchable fabric onto the tension tape with an adhesive such as a tape-shaped adhesive. It is preferable to form the second reinforcing bands by bonding a tension tape to a stretchable fabric constituting the swimsuit with an adhesive such as a tape-shaped adhesive and thereafter bonding a tape-shaped stretchable fabric onto the tension tape with an adhesive such as a tape-shaped adhesive, from the viewpoint of more effectively stabilizing the posture of the lower extremity in the water.

The second reinforcing bands have an elongation percentage in the longitudinal direction of preferably 0% or more and 35% or less, and more preferably 0% or more and 30% or less, from the viewpoint of stabilizing the posture of the lower extremity in the water and increasing the effect of supporting the movement of the hamstrings. Specifically the tape-shaped adhesive, the tape-shaped stretchable fabric, or the tension tape has an elongation percentage in the longitudinal direction of preferably 20% or more and 65% or less, and more preferably 20% or more and 60% or less.

The second reinforcing bands have a width of preferably 5 mm or more and 30 mm or less, and more preferably 10 mm or more and 20 mm or less, from the viewpoint of reducing the surface friction, for example. Specifically, the tape-shaped adhesive, the tape-shaped stretchable fabric, and the tension tape have a width of preferably 5 mm or more and 30 mm or less, and more preferably 10 mm or more and 20 mm or less, from the viewpoint of reducing the surface friction, for example.

The adhesive is preferably a hot melt adhesive. Examples of the hot melt adhesive include, but are not particularly limited to, a sheet type, a nonwoven fabric type, and a liquid type. The sheet type and the nonwoven fabric type may be cut into a tape shape with a predetermined width, arranged at a place where the second reinforcing bands are to be positioned, and heated. The liquid type may be applied in a tape shape with a predetermined width to a place where the second reinforcing bands are to be positioned, and heated.

As the tape-shaped stretchable fabric, those exemplified above as the stretchable fabric constituting the swimsuit that are cut into a tape shape with a predetermined width can be used appropriately.

The tension tape is not particularly limited, and may be either a knitted fabric or a woven fabric. For example, a variety of commercially available tension bands can be selected appropriately. The tension tape has a tensile elastic modulus in the body length direction of preferably, but not particularly limited to, $5\times10^{-5}$ N/mm$^2$ or more and $30\times10^{-5}$ N/mm$^2$ or less, and more preferably $10\times10^{-5}$ N/mm$^2$ or more and $20\times10^{-5}$ N/mm$^2$ or less.

The configuration of the second reinforcing bands may be the same as or different from that of the first reinforcing bands.

The swimsuit of the present invention can more effectively stabilize the posture of the lower extremity in the water and support the movement of the hamstrings, by including the second tightening portion and the second reinforcing bands in the positions corresponding to the buttocks and the thighs. The second tightening portion has a tensile elastic modulus in the body length direction of preferably $160\times10^{-5}$ N/mm$^2$ or more and $220\times10^{-5}$ N/mm$^2$ or less, more preferably $165\times10^{-5}$ N/mm$^2$ or more and $200\times10^{-5}$ N/mm$^2$ or less, and further preferably $170\times10^{-5}$ N/mm$^2$ or more and $190\times10^{-5}$ N/mm$^2$ or less. An area of the swimsuit where the second tightening portion and one second reinforcing band are positioned has a tensile elastic modulus in the body length direction of preferably $180\times10^{-5}$ N/mm$^2$ or more and $340\times10^{-5}$ N/mm$^2$ or less, more preferably $200\times10^{-5}$ N/mm$^2$ or more and $320\times10^{-5}$ N/mm$^2$ or less, and further preferably $220\times10^{-5}$ N/mm$^2$ or more and $300\times10^{-5}$ N/mm$^2$ or less. An area of the swimsuit where the second tightening portion and the intersection of the two second reinforcing bands are positioned has a tensile elastic modulus in the body length direction of preferably $220\times10^{-5}$ N/mm$^2$ or more and $420\times10^{-5}$ N/mm$^2$ or less, more preferably $240\times10^{-5}$ N/mm$^2$ or more and $400\times10^{-5}$ N/mm$^2$ or less, and further preferably $260\times10^{-5}$ N/mm$^2$ or more and $380\times10^{-5}$ N/mm$^2$ or less. By setting the tensile elastic modulus in the body length direction of each of the second tightening portion, the area where the second tightening portion and one second reinforcing band are positioned, and the area where the second tightening portion and the intersection of the two second reinforcing bands are positioned, to the above range, a resultant swimsuit is easy to wear and has an improved effect of supporting the movement of hamstrings, including supporting kicks.

Figure 1B:
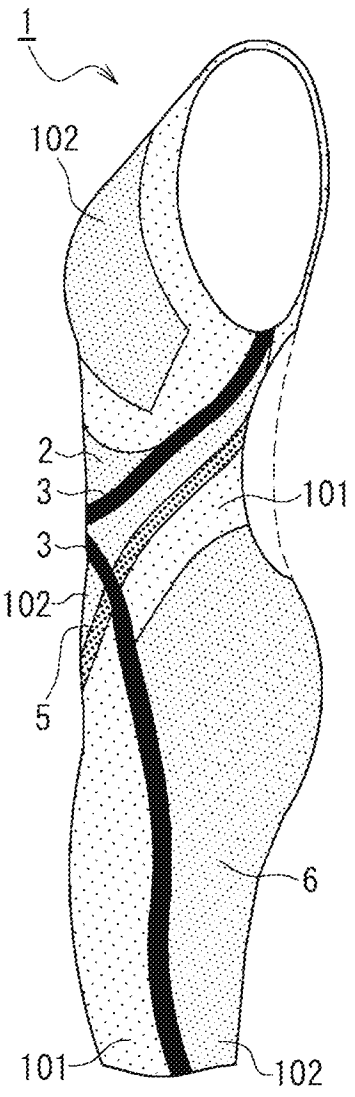
FIG. 1B is the left side view.
Figure 1A:
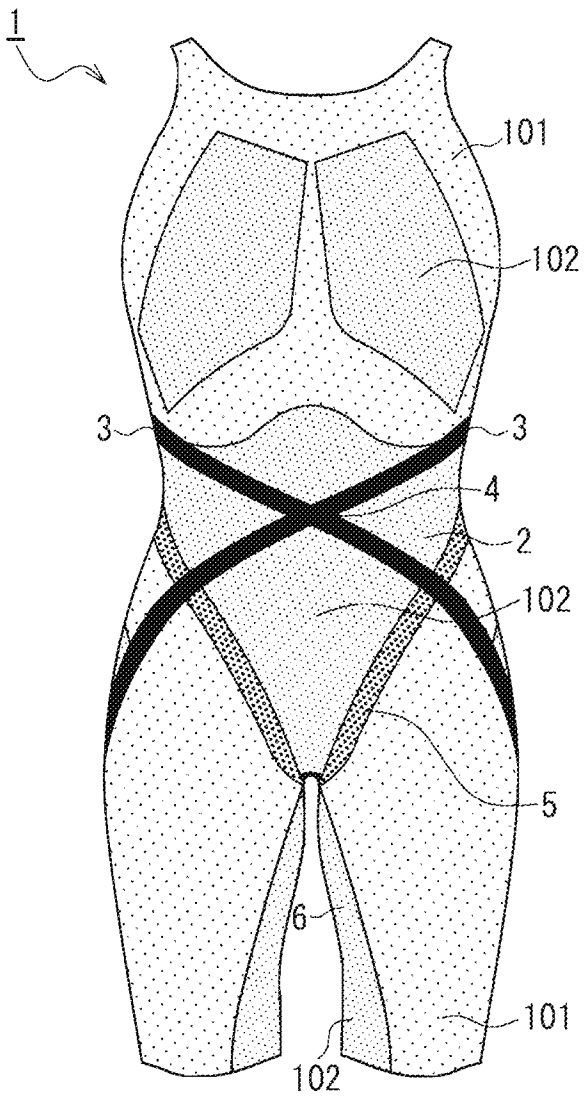
FIG. 1A is the front view.

The following describes swimsuits in one or more embodiments of the present invention using drawings. However, the present invention is not limited to those illustrated in the drawings. FIG. 1 schematically illustrates the inside (body surface side) of a swimsuit according to an embodiment of the present invention: FIG. 1A is the front view, FIG. 1B is the left side view, and FIG. 1C is the rear view. A swimsuit 1 of this embodiment is a women's all-in-one half spats type. As illustrated in FIG. 1, the swimsuit 1 includes a first tightening portion 2 configured to cover the entire abdomen and extend to the upper back; and a pair of symmetric first reinforcing bands 3 each configured to extend from one side of an armhole of the swimsuit across the abdomen to the lateral thigh on the other side and down to an end portion of the swimsuit, the pair of first reinforcing bands intersecting with each other in an area of the swimsuit covering the abdomen.

The swimsuit 1 has a back hole, and the first tightening portion is configured to cover part of the upper back, with the both ends of the first tightening portion 2 separate from each other on the upper side of the back hole. Alternatively, the both ends of the first tightening portion 2 may be connected with each other on the upper side of the back hole. The swimsuit 1 may include third reinforcing bands 5 arranged in a V shape in an area of the swimsuit covering the periphery of the groin region. The third reinforcing bands 5 may extend to the upper back. The third reinforcing bands 5 may be arranged to overlap the periphery of the first tightening portion 2.

The pair of first reinforcing bands 3 are arranged symmetrically and substantially in an X-shape as viewed from the front. An intersection 4 of the pair of first reinforcing bands is preferably positioned between the lower edge of the costal arch and the lower edge of the anterior superior iliac spine, and more preferably between the lower edge of the costal arch and the iliac crest, from the viewpoint of more effectively increasing the pressure to the abdomen and easily maintaining the flat posture. Under the armpit, the first reinforcing bands 3 may overlap the periphery of the first tightening portion 2.

The swimsuit 1 further includes a second tightening portion 6 configured to cover the buttock and the thigh on each of the left and right sides. The second tightening portion 6 can stabilize the posture of the lower extremity in the water and support the movement of the hamstrings.

Figure 2C:
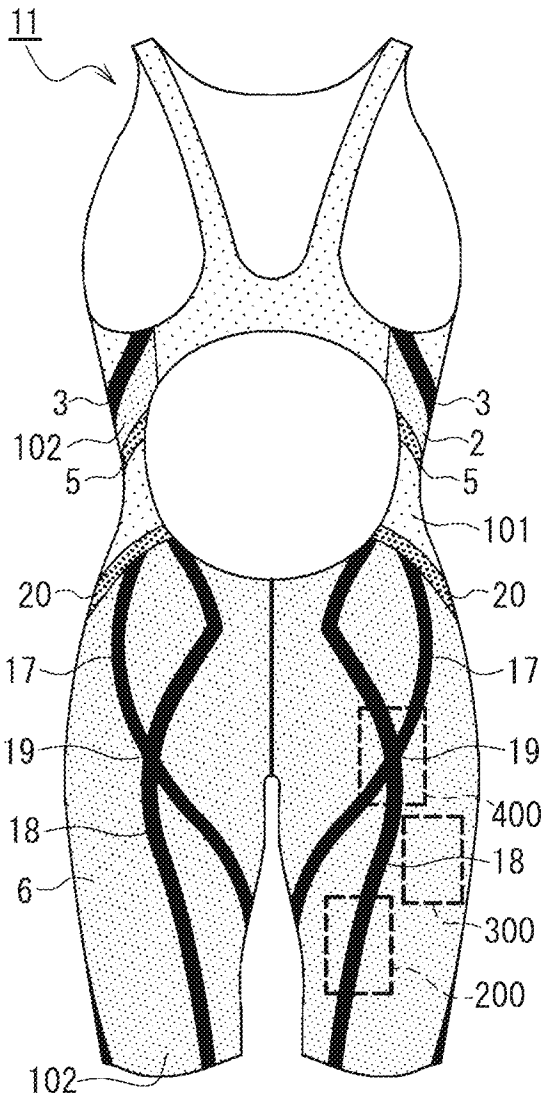
FIG. 2C is the rear view.
Figure 2B:
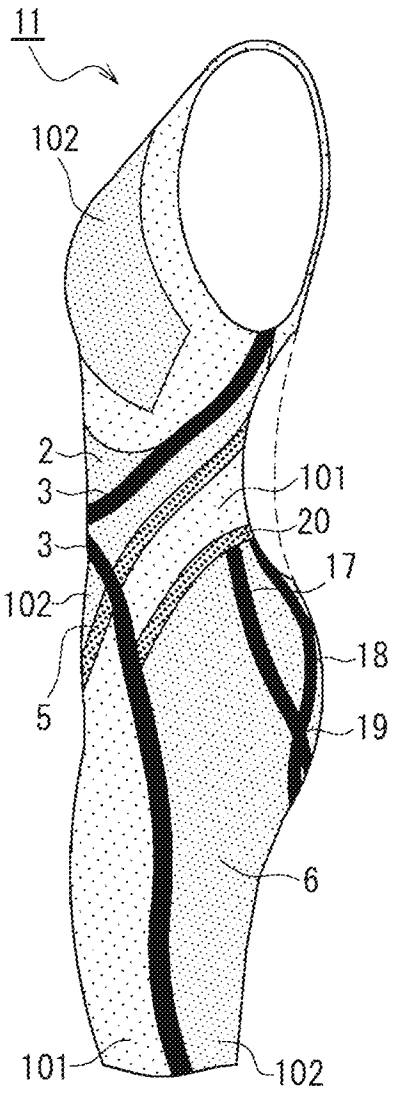
FIG. 2B is the left side view.
Figure 2A:
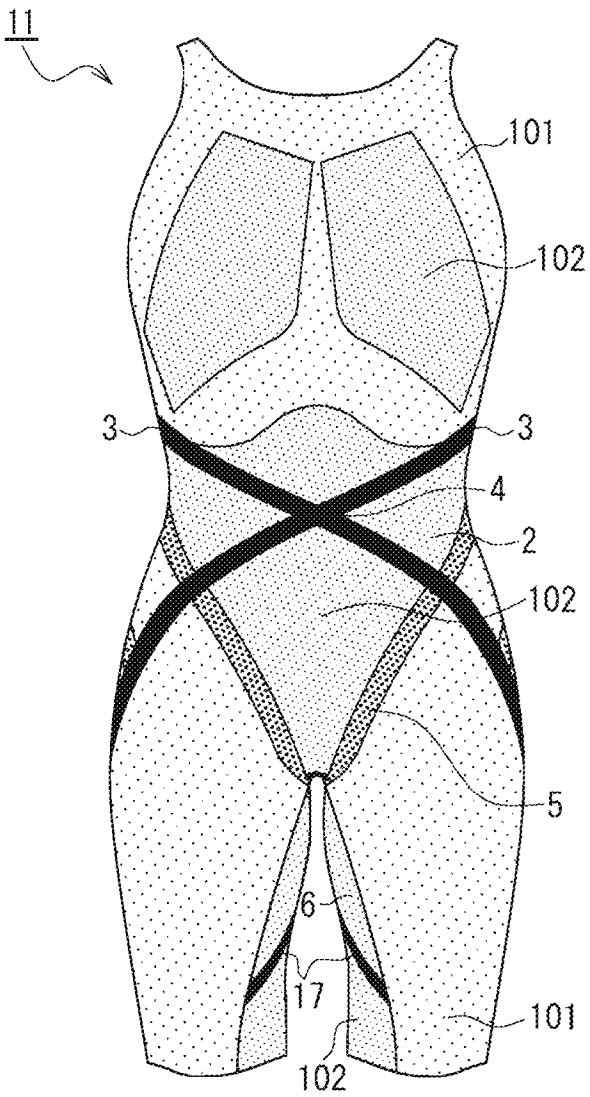
FIG. 2A is the front view.

FIG. 2 schematically illustrates the inside (body surface side) of a swimsuit according to another embodiment of the present invention: FIG. 2A is the front view, FIG. 2B is the left side view, and FIG. 2C is the rear view. A swimsuit 11 of this embodiment is a women's all-in-one half spats type. In FIG. 2, the same reference numeral as that in FIG. 1 denotes the same component, and the explanation will not be repeated.

The swimsuit 11 of this embodiment includes two second reinforcing bands 17 and 18 on each of the left and right sides that are configured to extend from the buttock to the thigh along the body length direction and intersect with each other, an intersection 19 of the second reinforcing bands 17 and 18 being positioned between the top of the buttock and the section of the hamstrings one-third from the proximal end of the hamstrings. The second reinforcing bands 17 and 18 are each arranged to extend from the waist to the medial thigh (inner thigh).

The second reinforcing band 18 may be arranged to extend from the waist to the lateral thigh. The second reinforcing bands 17 and 18 may be each arranged to extend to the lower end portion of the swimsuit 11. The number of the second reinforcing bands on each of the left and right sides is two in this embodiment, and it may be three or more, or four or more.

The swimsuit 11 on the rear side may include fourth reinforcing bands 20 arranged on the waist. The fourth reinforcing bands 20 can increase the effect of supporting the trunk further.

Both of the first tightening portion 2 and the second tightening portion 6 can be formed from a double cloth in which a back fabric 102 is placed on a face fabric 101 constituting the swimsuit.

The first reinforcing bands 3, the second reinforcing bands 17, 18, the third reinforcing bands 5, and the fourth reinforcing bands 20 may be formed from at least one selected from the group consisting of an adhesive, a stretchable fabric, and a tension tape, as described above. For example, the third reinforcing bands 5 may be formed from a tape-shaped adhesive obtained by bonding a fabric constituting the first tightening portion 2 and a fabric constituting other areas adjacent to the first tightening portion 2, together. The fourth reinforcing bands 20 may be formed from a tape-shaped adhesive obtained by bonding a fabric constituting the second tightening portion 6 and a fabric constituting other areas adjacent to the second tightening portion 6, together.

The total number of seams in the circumferential direction of the buttocks, including the number of stitch lines and the number of the reinforcing bands, is preferably 9 or less from the viewpoint of wearability. Further, the total number of seams in the circumferential direction of each of the left and right thighs from a crotch portion to an above-knee portion, including the number of stitch lines and the number of the reinforcing bands, is preferably 4 or less from the viewpoint of wearability.

Figure 3C:
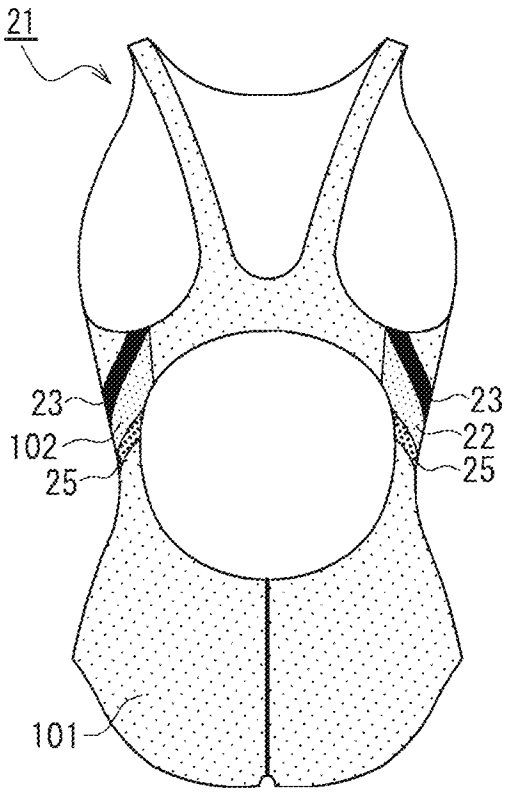
FIG. 3C is the rear view.
Figure 3B:
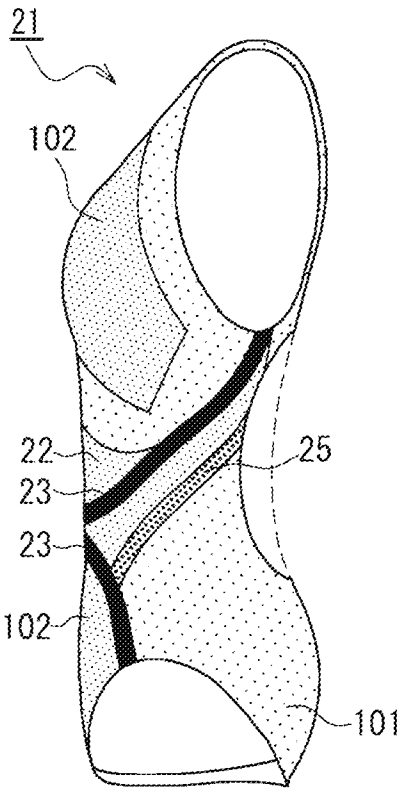
FIG. 3B is the left side view.
Figure 3A:
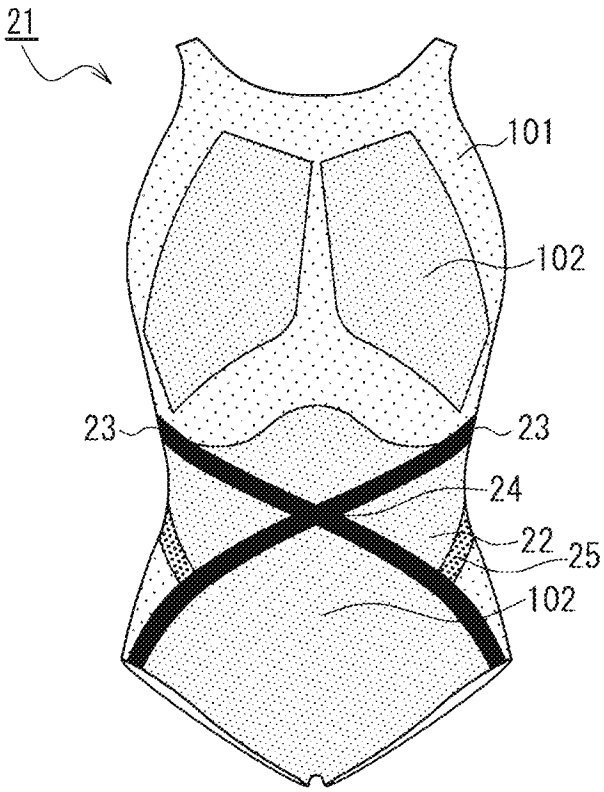
FIG. 3A is the front view.

FIG. 3 schematically illustrates the inside (body surface side) of a swimsuit according to another embodiment of the present invention: FIG. 3A is the front view, FIG. 3B is the left side view, and FIG. 3C is the rear view. A swimsuit 21 of this embodiment is a women's one-piece type. As illustrated in FIG. 3, the swimsuit 21 includes a first tightening portion 22 configured to cover the entire abdomen and extend to the upper back; and a pair of symmetric first reinforcing bands 23 each configured to extend from one side of an armhole of the swimsuit across the abdomen and down to an end portion of the swimsuit on the other side, the pair of first reinforcing bands intersecting with each other in an area of the swimsuit covering the abdomen. As illustrated in FIG. 3, the first tightening portion 22 may be arranged in the front lower part of the swimsuit to entirely cover a region where the pair of first reinforcing bands 23 are interposed (the region including the abdomen and the periphery of the base of the thighs).

The swimsuit 21 has a back hole, and the first tightening portion is configured to cover part of the upper back, with the both ends of the first tightening portion 22 separate from each other on the upper side of the back hole. Alternatively, the both ends of the first tightening portion 22 may be connected with each other on the upper side of the back hole. The swimsuit 21 may include third reinforcing bands 25 configured to extend from the lateral abdomen to the upper back. The third reinforcing bands 25 may be arranged to overlap the periphery of the first tightening portion 22.

The pair of first reinforcing bands 23 are arranged symmetrically and substantially in an X-shape as viewed from the front. An intersection 24 of the pair of first reinforcing bands is preferably positioned between the lower edge of the costal arch and the lower edge of the anterior superior iliac spine, and more preferably between the lower edge of the costal arch and the iliac crest, from the viewpoint of more effectively increasing the pressure to the abdomen and easily maintaining the flat posture. Under the armpit, the first reinforcing bands 23 may overlap the periphery of the first tightening portion 22.

Figure 4C:
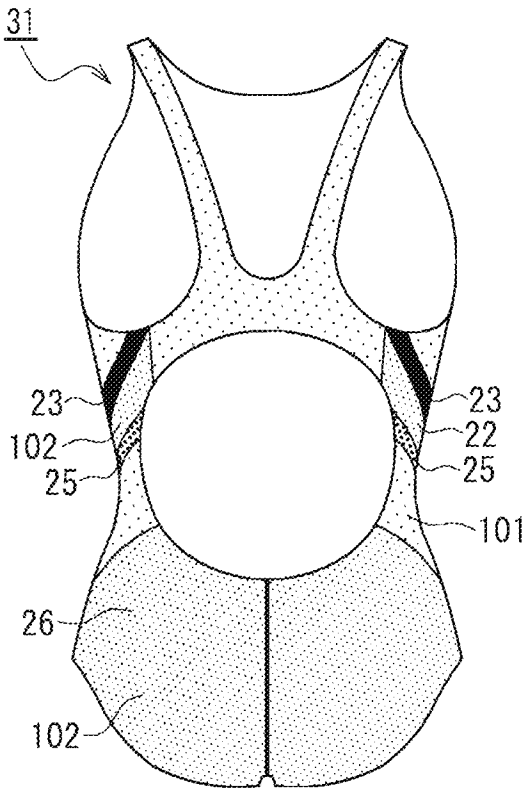
FIG. 4C is the rear view.
Figure 4B:
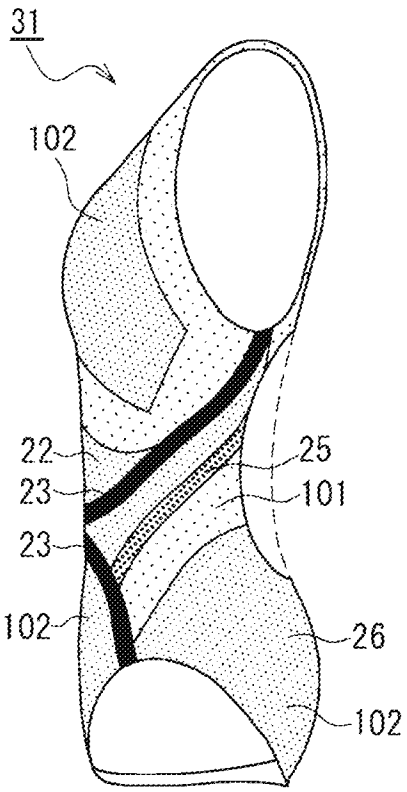
FIG. 4B is the left side view.
Figure 4A:
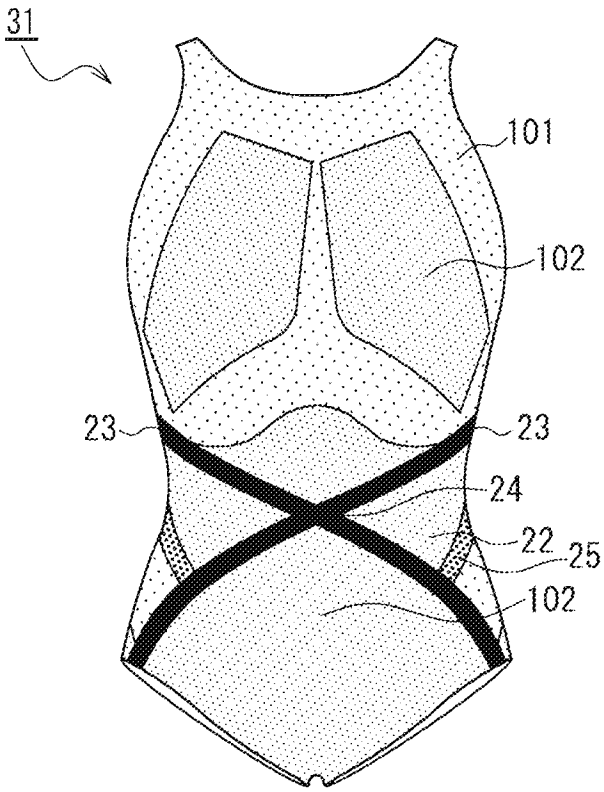
FIG. 4A is the front view.

FIG. 4 schematically illustrates the inside (body surface side) of a swimsuit according to another embodiment of the present invention: FIG. 4A is the front view, FIG. 4B is the left side view, and FIG. 4C is the rear view. A swimsuit 31 of this embodiment is a women's one-piece type. In FIG. 4, the same reference numeral as that in FIG. 3 denotes the same component, and the explanation will not be repeated.

The swimsuit 31 further includes a second tightening portion 26 configured to cover the buttock on each of the left and right sides.

Both of the first tightening portion 22 and the second tightening portion 26 can be formed from a double cloth in which a back fabric 102 is placed on a face fabric 101 constituting the swimsuit.

The first reinforcing bands 23 and the third reinforcing bands 25 may be formed from at least one selected from the group consisting of an adhesive, a stretchable fabric, and a tension tape, as described above. For example, the third reinforcing bands 25 may be formed from a tape-shaped adhesive obtained by bonding a fabric constituting the first tightening portion 22 and a fabric constituting other areas adjacent to the first tightening portion 22, together.

The swimsuits illustrated in FIGS. 1 to 4 have a configuration in which the tightening portions and the reinforcing bands are arranged on the inside (body surface side) of the swimsuits. However, the swimsuit of the present invention is not limited to these. For example, all or some of the tightening portions and the reinforcing bands may be arranged on the outside of the swimsuit. The configurations of the women's swimsuits illustrated in FIGS. 1 to 4 are applicable to any swimsuits, including other types of women's swimsuits and men's swimsuits that are configured to cover at least the buttocks and the abdomen in use. Various modifications can be made as appropriate within the scope of the present invention to an extent apparent to those skilled in the art.

Although not particularly limited, the present invention preferably includes the following aspects.

[1] A swimsuit formed from a stretchable fabric that is configured to cover at least the buttocks and the abdomen in use, including:

- a first tightening portion configured to cover the entire abdomen and extend to the upper back; and
- a pair of symmetric first reinforcing bands, each configured to extend from one side of an armhole of the swimsuit across the abdomen and down to an end portion of the swimsuit on the other side, the pair of first reinforcing bands intersecting with each other in an area of the swimsuit covering the abdomen.

[2] The swimsuit according to [1], wherein the pair of first reinforcing bands are each configured to extend from one side of the armhole of the swimsuit across the abdomen to the lateral thigh on the other side and down to the end portion of the swimsuit.

[3] The swimsuit according to [1] or [2], wherein the first tightening portion is formed from a double cloth.

[4] The swimsuit according to any one of [1] to [3], wherein the pair of first reinforcing bands are formed from at least one selected from the group consisting of an adhesive, a stretchable fabric, and a tension tape.

[5] The swimsuit according to any one of [1] to [4], wherein the intersection of the pair of first reinforcing bands is configured to be positioned between the lower edge of the costal arch and the lower edge of the anterior superior iliac spine.

[6] The swimsuit according to any one of [1] to [5], wherein the swimsuit has a clothing pressure of 22 hPa or more at a part 5 cm horizontally away from the intersection of the pair of first reinforcing bands.

[7] The swimsuit according to any one of [1] to [6], wherein the swimsuit has a clothing pressure of 1.5 hPa or more at a part 7 cm vertically away from the intersection of the pair of first reinforcing bands.

[8] The swimsuit according to any one of [1] to [7], wherein the swimsuit further includes a second tightening portion configured to cover the buttock and at least part of the thigh on each of the left and right sides.

[9] The swimsuit according to [8], wherein the second tightening portion is formed from a double cloth.

[10] The swimsuit according to any one of [1] to [9], wherein the swimsuit includes two or more second reinforcing bands on each of the left and right sides that are configured to extend from the buttock to the thigh along the body length direction and intersect with each other, the intersection of the two or more second reinforcing bands being configured to be positioned between the top of the buttock and a section of the hamstrings one-third from the proximal end of the hamstrings.

[11] The swimsuit according to [10], wherein the intersection of the two or more second reinforcing bands is configured to be positioned in an area of the swimsuit covering part of the hamstrings.

[12] The swimsuit according to any one of [1] to [11], wherein the swimsuit is a competition swimsuit.

EXAMPLES

Hereinafter, examples of the present invention will be described. However, the present invention is not limited to these examples.

The following fabrics were used in the examples and comparative examples.

Fabric 101: The face fabric was a woven fabric combining plain weave and double weave and having a mass per unit area of 138 g/m$^2$. The fiber composition of the woven fabric was 65% nylon fiber and 35% elastic polyurethane fiber. As a warp, elastic polyurethane fibers (fineness: 78 dtex) covered with nylon fibers (fineness: 33 dtex, 10 filaments) were used. As wefts, elastic polyurethane fibers (fineness: 55 dtex) covered with nylon fibers (fineness: 33 dtex, 10 filaments) and elastic polyurethane fibers (fineness: 44 dtex) covered with nylon fibers (fineness: 33 dtex, 10 filaments) were used. The density (thread count) of the warp was 184 threads/inch, and the density of the weft was 188 threads/inch. The fabric was arranged so that the warp ran along the circumferential direction. The fabric 101 had an elongation percentage in the body length direction of 37.4% and that in the body width direction of 53.3%.

Fabric 102: The back fabric was a plain-woven fabric having a mass per unit area of 114 g/m$^2$. The fiber composition of the woven fabric was 66% nylon fiber and 34% elastic polyurethane fiber. As a warp, elastic polyurethane fibers (fineness: 55 dtex) covered with nylon fibers (fineness 24 dtex, 7 filaments) were used. As a weft, elastic polyurethane fibers (fineness: 44 dtex) covered with nylon fibers (fineness: 24 dtex, 7 filaments) were used. The density (thread count) of the warp was 219 threads/inch, and the density of the weft was 187 threads/inch. The fabric was arranged so that the warp ran along the circumferential direction. The fabric 102 had an elongation percentage in the body length direction of 54.6% and that in the body width direction of 49.5%.

Double cloth: A double cloth was prepared by bonding the edges of the fabric 101 and the fabric 102 together using a hot melt adhesive (trade name "J861" manufactured by UTAX CO., LTD.®). Both of the fabric 101 and the fabric 102 were arranged so that the warp ran along the circumferential direction. The double cloth had an elongation percentage in the body length direction of 30.9% and that in the body width direction of 56.8%.

Stretchable fabric for reinforcing band: The stretchable fabric was a plain-woven fabric having a mass per unit area of 140 g/m$^2$. The fiber composition of the woven fabric was 63% nylon fiber and 37% elastic polyurethane fiber. As a warp, elastic polyurethane fibers (fineness: 78 dtex) covered with nylon fibers (fineness: 33 dtex, 10 filaments) were used. As a weft, elastic polyurethane fibers (fineness: 55 dtex) covered with nylon fibers (fineness: 33 dtex, 10 filaments) were used. The density (thread count) of the warp was 178 threads/inch, and the density of the weft was 180 threads/inch.

Tension tape for reinforcing band:"RF-6200" manufactured by SAN CHEMICALS, LTD. (a knit formed from polyester fibers, width:10 mm, elastic modulus in the longitudinal direction: 17.5×10Q N/mm2)

(Example 1)

A women's all-in-one half spats type swimsuit 11 (M size according to the Association of Japan Sporting Goods (JASPO) standard) such as that illustrated in FIG. 2 was produced using the fabric 101 and the double cloth (a combination of the fabric 101 and the fabric 102 bonded together). A first tightening portion 2 was formed from the double cloth of the fabric 101 and the fabric 102 and configured to cover the entire abdomen and extend to the upper back, as illustrated in FIG. 2. A second tightening portion 6 was formed from the double cloth of the fabric 101 and the fabric 102 and configured to cover the buttocks and the thighs, as illustrated in FIG. 2.

A pair of first reinforcing bands 3 were each formed by applying a tape-shaped hot melt adhesive (trade name "J8G1" manufactured by UTAX CO., LTD.®, width: 20 mm) to the inside of the first tightening portion 2 so that two pieces of the tape-shaped adhesive symmetrically extended from one side of an armhole of the swimsuit across the abdomen to the lateral thigh on the other side and down to an end portion of the swimsuit, and an intersection 4 of the two pieces of the tape-shaped adhesive was positioned in an area of the swimsuit covering the navel, as illustrated in FIG. 2.

Two second reinforcing bands 17 and 18 were arranged on each of the left and right sides to extend from the buttock to the thigh along the body length direction and intersect with each other, an intersection 19 of the two second reinforcing bands 17 and 18 being positioned between the top of the buttock and the section of the hamstrings one-third from the proximal end. Specifically, the second reinforcing band 17 was arranged to extend from the waist to the medial thigh. The second reinforcing band 18 was arranged to extend from the waist toward the medial thigh and to the lower end portion of the swimsuit 1. The intersection 19 was arranged to be positioned between a lower edge 1004 of the buttock and a portion near the gluteal fold. Here, the term the "lower edge of the buttock" means a section at a distance of 100%/4 from the lower end 1012 of the gluteus maximus, provided that the length of the gluteus maximus 1010 in the body height direction from the upper end 1011 to the lower end 1012 thereof is taken as 100%. The second reinforcing bands 17 and 18 were each formed by first bonding a piece of a tension tape for reinforcing band ("RF-6200" manufactured by SAN CHEMICALS, LTD., a knit formed from polyester fibers, width:10 mm, elastic modulus in the longitudinal direction: $17.5\times10^{-5}$ N/mm$^2$) to the inside (body surface side) of the second tightening portion 6 with a hot melt adhesive so that the longitudinal direction of the tension tape matched the body length direction, and then further bonding the stretchable fabric for reinforcing band that was cut into a tape-like shape having a width of 20 mm onto the tension tape with a hot melt adhesive (trade name "J861" manufactured by UTAX CO., LTD.®, width: 20 mm) so that the stretchable fabric covered the tension tape and the longitudinal direction (weft direction) of the tape-shaped stretchable fabric for reinforcing band matched the body length direction.

Third reinforcing bands 5 were each formed by bonding the stretchable fabric for reinforcing band that was cut into a tape-like shape having a width of 20 mm with a hot melt adhesive (trade name "J86 1" manufactured by UTAX CO., LTD.®, width: 20 mm).

Fourth reinforcing bands 20 were each formed by bonding the stretchable fabric for reinforcing band that was cut into a tape-like shape having a width of 20 mm with a hot melt adhesive (trade name "J86 1" manufactured by UTAX CO., LTD.®, width: 20 mm).

(Example 2)

A swimsuit 11 of Example 2 was produced in the same manner as in Example 1 except that the pair of first reinforcing bands 3 were each formed by bonding the stretchable fabric for reinforcing band that was cut into a tape-like shape having a width of 20 mm to the inside of the first tightening portion 2 with a tape-shaped hot melt adhesive (trade name "J86 1" manufactured by UTAX CO., LTD.®, width: 20 mm).

(Example 3)

A swimsuit 11 of Example 3 was produced in the same manner as in Example 1 except that the pair of first reinforcing bands 3 were each formed by first bonding a piece of a tension tape for reinforcing band ("RF-6200" manufactured by SAN CHEMICALS, LTD., a knit formed from polyester fibers, width:10 mm, elastic modulus in the longitudinal direction: $17.5\times10^{-5}$ N/mm$^2$) to the inside of the second tightening portion 2 with a hot melt adhesive so that the longitudinal direction of the tension tape matched the body length direction, and then further bonding the stretchable fabric for reinforcing band that was cut into a tape-like shape having a width of 20 mm onto the tension tape with a hot melt adhesive (trade name "J861" manufactured by UTAX CO., LTD.®, width: 20 mm) so that the stretchable fabric covered the tension tape.

(Example 4)

A women's one-piece type swimsuit 21 (M size according to the JASPO standard) such as that illustrated in FIG. 3 was produced using the fabric 101 and the double cloth (a combination of the fabric 101 and the fabric 102 bonded together). A first tightening portion 22 was formed from the double cloth of the fabric 101 and the fabric 102 and configured to cover the entire abdomen and extend to the upper back, as illustrated in FIG. 3.

A pair of first reinforcing bands 23 were each formed by applying a tape-shaped hot melt adhesive (trade name "J861" manufactured by UTAX CO., LTD.®, width: 20 mm) to the inside of the first tightening portion 22 so that two pieces of the tape-shaped adhesive symmetrically extended from one side of an armhole of the swimsuit across the abdomen to an end portion of the swimsuit on the other side, and an intersection 24 of the two pieces of the tape-shaped adhesive was positioned in an area of the swimsuit covering the navel, as illustrated in FIG. 3.

The third reinforcing band 25 was formed by bonding the double cloth constituting the first tightening portion 22 and the fabric 101 constituting other areas with a hot melt adhesive (trade name "J861" manufactured by UTAX CO., LTD.®, width: 20 mm).

Comparative Example 1

A one-piece type swimsuit such as that illustrated in FIG. 3 but not including tightening portions or reinforcing bands was produced using the fabric 101.

(Comparative Example 2)

Figure 6C:
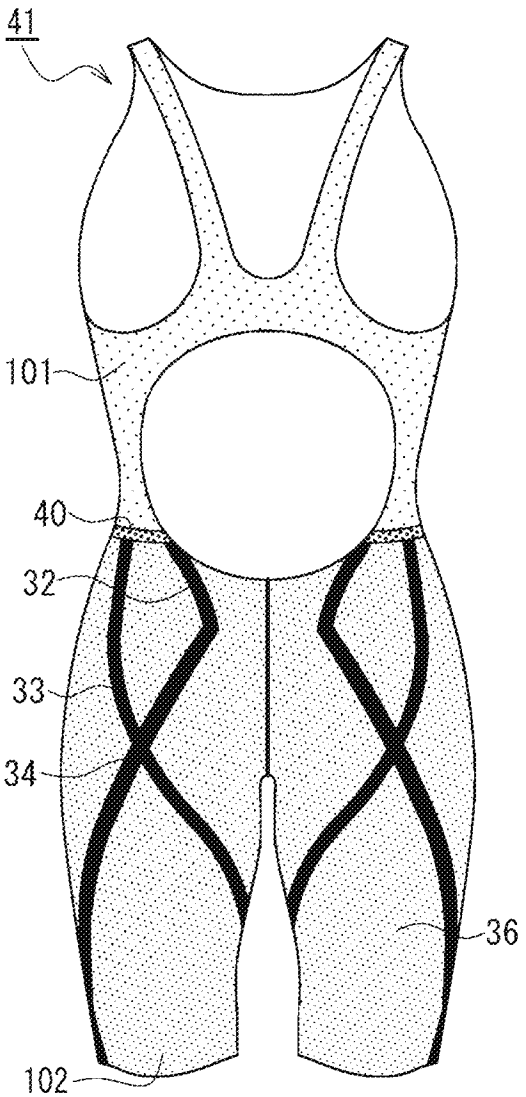
FIG. 6B is the left side view and FIG. 6C is the rear view.
Figure 6B:
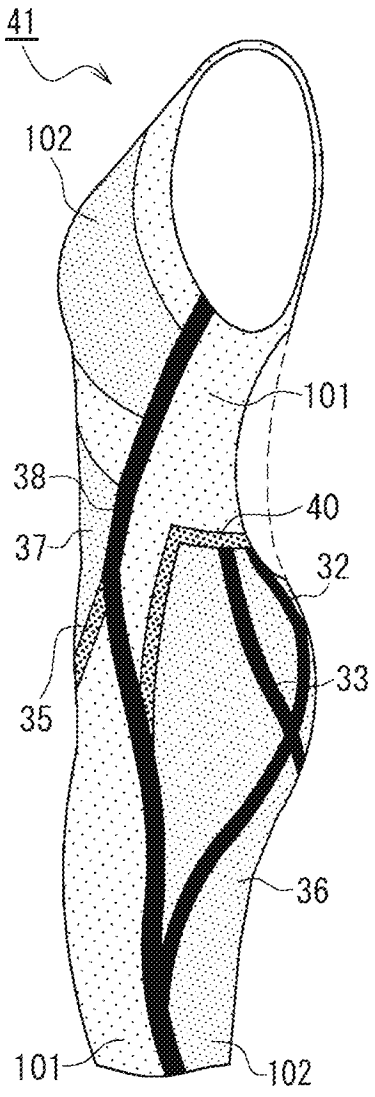
Figure 6A:
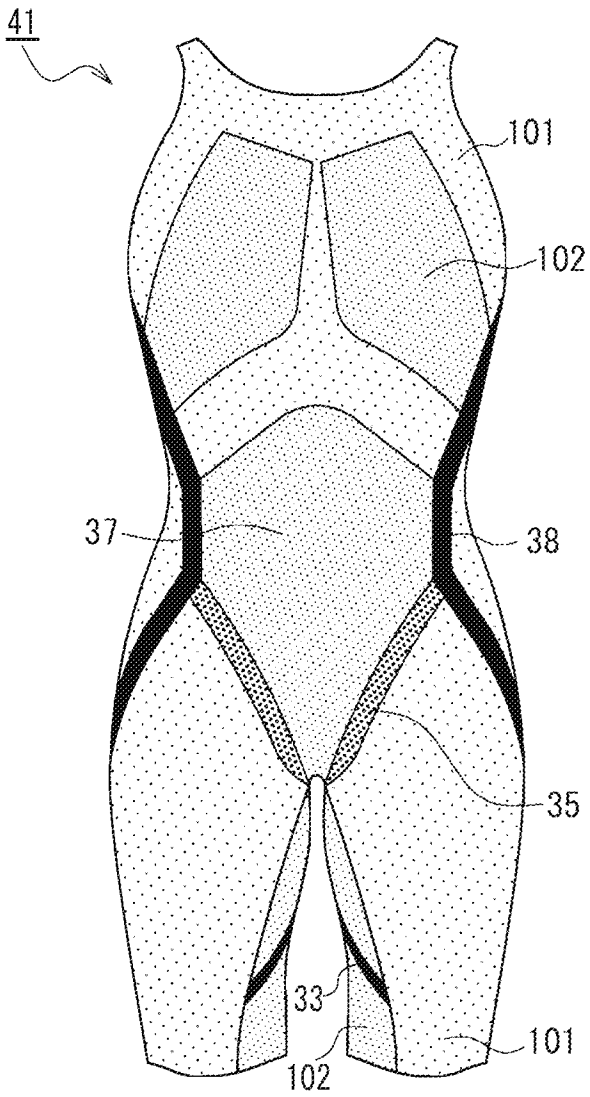
FIG. 6A is the front view.

A women's all-in-one half spats type swimsuit 41 (M size according to the JASPO standard) such as that illustrated in FIG. 6 was produced using the fabric 101 and the double cloth (a combination of the fabric 101 and the fabric 102 bonded together). A tightening portion 36 configured to cover the buttocks and the thighs and a tightening portion 37 configured to cover the abdomen except the lateral abdomen were formed using the double cloth. As illustrated in FIG. 6, two second reinforcing bands 32 and 33 were arranged on each of the left and right sides to extend from the buttock to the thigh along the body length direction and intersect with each other, an intersection 34 of the second reinforcing bands 32 and 33 being positioned between the top of the buttock and the section of the hamstrings one-third from the proximal end. Specifically, the second reinforcing band 32 was arranged to extend from the waist to the lateral thigh and to the lower end portion of the swimsuit 41. The second reinforcing band 33 was arranged to extend from the waist to the medial thigh. The intersection 34 was arranged to be positioned between the lower edge of the buttock and the portion near the gluteal fold. The second reinforcing bands 32, 33 and reinforcing bands 38 arranged on the lateral side of the swimsuit were each formed by first bonding a piece of a tension tape for reinforcing band ("RF-6200" manufactured by SAN CHEMICALS, LTD., a knit formed from polyester fibers, width: 10 mm, elastic modulus in the longitudinal direction: $17.5\times10^{-5}$ N/mm$^2$) with a hot melt adhesive so that the longitudinal direction of the tension tape matched the body length direction, and then further bonding the stretchable fabric for reinforcing band that was cut into a tape-like shape having a width of 20 mm onto the tension tape with a hot melt adhesive (trade name "J8G 1" manufactured by UTAX CO., LTD.®, width: 20 mm) so that the stretchable fabric covered the tension tape and the longitudinal direction (weft direction) of the tape-shaped stretchable fabric for reinforcing band matched the body length direction. Reinforcing bands 35 arranged in a V shape in an area of the swimsuit covering the groin region and reinforcing bands 40 arranged in the waist were each formed by bonding the stretchable fabric for reinforcing band that was cut into a tape-like shape having a width of 20 mm with a hot melt adhesive (trade name"J861" manufactured by UTAX CO., LTD.®, width: 20 mm).

As illustrated in FIG. 2C, a piece of a fabric 200 having a width of 5 cm and a length of 15 cm (an area where the second tightening portion and one second reinforcing band are arranged), a piece of a fabric 300 having a width of 5 cm and a length of 15 cm (the second tightening portion), and a piece of fabric 400 having a width of 5 cm and a length of 15 cm (an area where the second tightening portion and the intersection of the two second reinforcing bands are arranged) were cut from the swimsuit 11. Then, the tensile elastic modulus of each of the fabrics was measured. Table 1 below shows the results.

Measurement of Tensile Elastic Modulus

The tensile elastic modulus ($N/mm^2$) was measured based on JIS L 1096 8.14., Method A. Specifically, a piece of a fabric was fixed to a tensile tester such that the piece of the fabric had a width of 5 cm and a length of 10 cm, and then elongated, and the tensile elastic modulus ($N/mm^2$) of the fabric in the body length direction was determined from the gradient of stress at 5% elongation.

TABLE 1

| Piece of fabric | 200 | 300 | 400 |
|---|---|---|---|
| Tensile elastic modulus in body length direction ($N/mm^2$) | $252.63 \times 10^{-5}$ | $179.8 \times 10^{-5}$ | $315.8 \times 10^{-5}$ |

The clothing pressures by the swimsuits of Examples 1 to 4 and Comparative Examples 1 to 2 were measured in the following manner. Table 2 below shows the results.

(Measurement of Clothing Pressure)

The clothing pressure was measured using a clothing pressure measuring device (product name "contact pressure measuring device AMI 3032-2 (2B)" manufactured by AMI® Techno CO., LTD.) by attaching clothing pressure sensors to the following measurement parts on a mannequin (female mannequin manufactured by SUN CREATE CO., LTD.): a part corresponding to the navel (measurement part 1); a part 5 cm horizontally (body width direction) away from the navel (measurement part 2); and a part 7 cm vertically (body length direction) away from the navel (measurement part 3).

TABLE 2

| | Clothing pressure (hPa) | | |
|---|---|---|---|
| Measurement part | 1 | 2 | 3 |
| Example 1 | 36.2 | 22.9 | 2.1 |
| Example 2 | 40.8 | 24.1 | 2.6 |
| Example 3 | 45.3 | 27.4 | 3.7 |
| Example 4 | 34.8 | 22.0 | 1.9 |
| Comparative Example 1 | 5.1 | 7.2 | 0.4 |
| Comparative Example 2 | 23.1 | 21.8 | 1.1 |

As can be seen from the comparison between Comparative Example 1 and Comparative Example 2, the first tightening portion increased the clothing pressure in the abdomen, that is, the first tightening portion increased the pressure to the abdomen. The comparisons between Examples 1 to 4 and Comparative Example 2 indicate that the first tightening portion and the first reinforcing bands generated a synergistic effect, thereby increasing the clothing pressure not only at the area where both of the first tightening portion and the first reinforcing band were arranged (e.g., the measurement part 1) but also at the area where only the first tightening portion was arranged (e.g., the measurement parts 2 and 3), that is, such a structure increased the pressure to the abdomen. In this manner, the first tightening portion and the first reinforcing bands can effectively increase the pressure to the abdomen, thus preventing the abdomen from sinking and supporting the wearer's flat posture.

The swimsuits of Examples 1 to 4 and Comparative Examples 1 to 2 were worn by female college students (9 swimmers) who were qualified for the Japan's Inter College Swimming Championships. Strokes listed in Table 3 below were timed in a 25 m pool from the start (dive) to the goal (wall touch). The measured times were compared with the time of Comparative Example 1 as a reference. A difference of "– (minus)" indicates that the time was faster than the time of Comparative Example 1. The degree that the swimsuit prevented the sinking of the body position during swimming (the positions of the abdomen and the lower extremity in the water) was evaluated in comparison with Comparative Example 2 in the following five grades. Table 3 below shows the results.

1: Low
2: Slightly low
3: Same
4: Slightly high
5: High

TABLE 3

| | | 25 m swimming time (second) | | | | | | Body position | | | | | |
|---|---|---|---|---|---|---|---|---|---|---|---|---|---|
| | | | | | | | | Comp. | | | | | |
| | | Comp. Ex. | | Ex. | | | | Ex. | | Ex. | | | |
| Wearer | Stroke | 1 | 2 | 1 | 2 | 3 | 4 | 1 | 2 | 1 | 2 | 3 | 4 |
| A | Breaststroke | 0 | −0.3 | −0.5 | −0.4 | −0.3 | −0.2 | 1 | 3 | 5 | 5 | 5 | 4 |
| B | Freestyle | 0 | −0.2 | −0.4 | −0.6 | −0.6 | −0.2 | 1 | 3 | 4 | 5 | 5 | 3 |
| C | Freestyle | 0 | −0.2 | −0.3 | −0.4 | −0.4 | −0.3 | 1 | 3 | 5 | 5 | 5 | 4 |
| D | Butterfly | 0 | −0.3 | −0.3 | −0.7 | −0.5 | −0.4 | 1 | 3 | 5 | 5 | 5 | 5 |
| E | Freestyle | 0 | −0.2 | −0.3 | −0.3 | −0.4 | −0.3 | 1 | 3 | 4 | 5 | 5 | 3 |
| F | Butterfly | 0 | −0.2 | −0.2 | −0.4 | −0.5 | −0.3 | 1 | 3 | 4 | 5 | 5 | 4 |
| G | Butterfly | 0 | −0.3 | −0.4 | −0.5 | −0.4 | −0.3 | 1 | 3 | 4 | 4 | 5 | 4 |

TABLE 3-continued

| | | 25 m swimming time (second) | | | | | | Body position | | | | | |
|---|---|---|---|---|---|---|---|---|---|---|---|---|---|
| | | Comp. Ex. | | Ex. | | | | Comp. Ex. | | Ex. | | | |
| Wearer | Stroke | 1 | 2 | 1 | 2 | 3 | 4 | 1 | 2 | 1 | 2 | 3 | 4 |
| H | Freestyle | 0 | −0.2 | −0.5 | −0.3 | −0.4 | −0.2 | 1 | 3 | 5 | 4 | 4 | 3 |
| I | Freestyle | 0 | −0.2 | −0.2 | −0.7 | −0.3 | −0.3 | 1 | 3 | 5 | 5 | 5 | 4 |
| Average | | 0 | −0.23 | −0.34 | −0.48 | −0.42 | −0.28 | 1 | 3 | 4.6 | 4.8 | 4.9 | 3.8 |

* Ex.: Example, Comp. Ex.: Comparative Example

As can be understood from the data of Table 2 above, the swimsuits of the examples resulted in a higher body position than the swimsuits of the comparative examples. This indicates that the swimsuits of Examples 1 to 3 prevented the abdomen sinking and the lower extremity sinking during swimming, and the swimsuit of Example 4 prevented the abdomen sinking, thus supporting the flat posture. Further, the swimsuits of the examples resulted in faster times than the swimsuits of the comparative examples. This indicates that the swimsuits of Examples 1 to 3 also prevented the leg sinking in addition to the abdomen sinking during swimming and maintained the flat posture further, resulting in faster times.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

INDUSTRIAL APPLICABILITY

The swimsuit of the present invention, which can be used also as a practice swimsuit, is suitable as a women's competition swimsuit.

DESCRIPTION OF REFERENCE NUMERALS

1, 11, 21, 31, 41 Swimsuit
2, 22 First tightening portion
3, 23 First reinforcing band
4, 24 Intersection of two first reinforcing bands
5, 25 Third reinforcing band
6, 26, 36 Second tightening portion
17, 18, 32, 33 Second reinforcing band
19, 34 Intersection of two second reinforcing bands
20 Fourth reinforcing band
35, 38, 40 Reinforcing band
37 Tightening portion
101 Face fabric
102 Back fabric
200, 300, 400 Piece of fabric
1001 Top of the buttock
1002 Hamstrings
1003 Position of intersection
1004 Lower edge of the buttock
1010 Gluteus maximus
1011 Upper end of the gluteus maximus
1012 Lower end of the gluteus maximus
1020 Gluteus medius
1030 Gluteus minimus
1040 Biceps femoris
1050 Semimembranosus
1060 Semitendinosus

The invention claimed is:

1. A swimsuit formed from a stretchable fabric, the swimsuit being configured to cover at least buttocks and an abdomen of a wearer of a corresponding size of the swimsuit when worn by the wearer, the swimsuit comprising:

an abdominal tightening panel attaching to an above abdominal member of the swimsuit, the above abdominal member being adjacently above the abdominal tightening panel, the abdominal tightening panel extending over an entirety of an abdominal portion of the swimsuit and extending to an upper back potion of the swimsuit, wherein the abdominal tightening panel has a first elastic modulus and the above abdominal member has a second elastic modulus, and the first elastic modulus is higher than the second elastic modulus; and a pair of symmetric first reinforcing bands, each configured to extend from a respective rear armhole portion on one of a left side and a right side of the swimsuit across the abdomen abdominal portion of the swimsuit and down to a lower edge of the swimsuit on the other one of the left side and right side of the swimsuit, the pair of symmetric first reinforcing bands intersecting with each other at the abdominal portion of the swimsuit;

wherein a first angle that is defined by the intersecting pair of symmetric first reinforcing bands is obtuse as viewed in the body length direction of the swimsuit.

2. The swimsuit according to claim 1, wherein the pair of symmetric first reinforcing bands are each configured to extend from the respective rear armhole portion on the one of the left side and the right side of the swimsuit across the abdomen to a lateral thigh of the wearer on the other one of the left side and the right side and down to the lower edge of the swimsuit.

3. The swimsuit according to claim 1, wherein the abdominal tightening panel is formed from a double cloth.

4. The swimsuit according to claim 1, wherein the pair of symmetric first reinforcing bands are formed from at least one selected from the group consisting of an adhesive, the stretchable fabric, and a tension tape.

5. The swimsuit according to claim 1, wherein the intersection of the pair of symmetric first reinforcing bands is configured to be positioned between the lower edge of a costal arch and a lower edge of an anterior superior iliac spine of the wearer.

6. The swimsuit according to claim 1, wherein the swimsuit has a clothing pressure of 22 hPa or more at a part spaced 5 cm from the intersection of the pair of symmetric first reinforcing bands in a direction extending between the respective armholes of the swimsuit.

7. The swimsuit according to claim 1, wherein the swimsuit has a clothing pressure of 1.5 hPa or more at a part spaced 7 cm from the intersection of the pair of symmetric first reinforcing bands in a direction extending between a neck hole and leg openings of the swimsuit.

8. The swimsuit according to claim 1, wherein the swimsuit further comprises a tightening portion configured to cover a respective buttock and at least part of a respective thigh on each of the left and right sides.

9. The swimsuit according to claim 8, wherein the tightening portion is formed from a double cloth.

10. The swimsuit according to claim 1, wherein the swimsuit comprises two or more second reinforcing bands on each of the left and right sides that are configured to extend from the buttock to a thigh of the wearer along the body length direction and intersect with each other, the intersection of the two or more second reinforcing bands being configured to be positioned between a top of a respective buttock and a section of a respective hamstring of the wearer one-third of a distance from a proximal end of the respective hamstring.

11. The swimsuit according to claim 10, wherein the intersection of the two or more second reinforcing bands is configured to be positioned in an area of the swimsuit configured to cover part of the hamstrings.

12. The swimsuit according to claim 1, wherein the pair of symmetric first reinforcing bands each have a width of 5 mm to 30 mm.

13. The swimsuit according to claim 10, wherein the two or more second reinforcing bands each have a width of 5 mm to 30 mm.

14. The swimsuit according to claim 1, wherein the swimsuit is a competition swimsuit.

15. The swimsuit according to claim 1, wherein the pair of symmetric first reinforcing bands overlap at a periphery of the abdominal tightening panel at a position configured to be on an armpit and the upper back portion of the swimsuit.

16. The swimsuit according to claim 1, wherein the abdominal tightening wrap includes a first end and a second end, wherein the first and second ends of the abdominal tightening panel are configured to be separated from one another at the upper back portion of the swimsuit.

17. The swimsuit according to claim 1, wherein a second angle defined by the intersecting pair of symmetric first reinforcing bands is acute as viewed in a body width direction of the swimsuit.

18. The swimsuit according to claim 1, wherein the abdominal tightening wrap has an elongation percentage in the body length direction of 10% to 50% and an elongation percentage in the body width direction of 20% to 70%.

19. The swimsuit according to claim 1, wherein the pair of symmetric first reinforcing bands have an elongation percentage in the longitudinal direction of 0% to 35%.

* * * * *